US006374519B1

(12) United States Patent
Beaumont

(10) Patent No.: US 6,374,519 B1
(45) Date of Patent: Apr. 23, 2002

(54) DREDGING APPARATUS

(75) Inventor: Robert Beaumont, Ewhurst Green (GB)

(73) Assignee: Seabed Impellex Levelling and Trenching Limited, Jersey (GB)

( * ) Notice: Subject to any disclaimer, the term of this patent is extended or adjusted under 35 U.S.C. 154(b) by 0 days.

(21) Appl. No.: 09/647,519

(22) PCT Filed: Apr. 1, 1999

(86) PCT No.: PCT/GB99/01015

§ 371 Date: Nov. 29, 2000

§ 102(e) Date: Nov. 29, 2000

(87) PCT Pub. No.: WO99/50508

PCT Pub. Date: Oct. 7, 1999

(30) Foreign Application Priority Data

Apr. 1, 1998 (GB) ..... 9807070

(51) Int. Cl.[7] ..... E02F 5/28

(52) U.S. Cl. ..... 37/307; 405/159

(58) Field of Search ..... 37/307, 309, 317, 37/320, 322, 323; 405/159, 163, 164

(56) References Cited

U.S. PATENT DOCUMENTS 4,190,382 A * 2/1980 Schmitz et al. ..... 405/159

FOREIGN PATENT DOCUMENTS

EP WO 97/32091 * 9/1997 ..... E02F/5/28

* cited by examiner

*Primary Examiner*—Robert E. Pezzuto
(74) *Attorney, Agent, or Firm*—Connolly Bove Lodge & Hutz, LLP

(57) ABSTRACT

A dredger for removing sand, silt and like material from a river or seabed has application to clearing wrecks and providing trenches in which, for example, pipeline may be laid. The dredger includes a body having first thrusters to direct, in use, a wash of water downwards an area of seabed. The dredger also includes an additional thruster to maintain the body of the apparatus above the seabed and to propel the body through the water.

17 Claims, 7 Drawing Sheets

DREDGING APPARATUS

BACKGROUND OF THE INVENTION

This invention relates to dredgers for removing sand, silt and like material from the river or sea bed and has application, for example to clearing wrecks, and providing trenches in which, for example, pipelines may be laid.

A suction dredger is the most widely used apparatus for removing such material, suction being created by a motor and pump unit, somewhat like a vacuum cleaner. However, if used for clearing wrecks, such apparatus has the disadvantage that small and/or lightweight articles from the wreck can also be lifted and, even if a screen is provided in the suction path, the articles may be small enough to pass through the screen, or be difficult to extract from the other debris lifted.

A modified form of the suction method, which is used in tidal waters, is to provide a vertical length of pipe above the area to be cleared near the lower end of which air is fed under pressure to pass upwardly through said pipe. This creates a vacuum, which will act to lift the sand, silt and like material and set it in suspension with the water, whereafter it may be carried away from the area by the tide. This method is reliable in reducing the possibility of small/lightweight articles being lost, but is time consuming due to the relatively small diameter of the pipe, normally around 0.5 meters, and hence restricted area covered.

Another method, which can be used in relatively shallow tidal waters, e.g. up to about 10 meters in depth, comprises mooring a tug, ship or other vessel in a fixed position above the area to be cleared and deflecting the propeller wash downwardly using a suitable guide plate. The wash disturbs the material around the wreck, which material is thereby lifted, set in suspension and carried away from the area by the tide. Apart from the shallow depth, another restriction of this method is that, for a large wreck, the position of the vessel must be changed progressively to cover the complete area of the wreck, which is difficult and time consuming.

EP-A-0328198 describes a method of dredging in flowing water comprising lowering a casing of a wing shape downwardly towards the area to be cleared, the casing carrying thrust means arranged so that the thrust means is directed downwardly, the orientation of the wing casing being adjusted in the water so that it presents a surface relative to the flow which causes a resultant downward vertical component of force to counteract the upward force provided by the thrust means, the thrust means directing a wash of water towards the areas to be cleared so that the turbulence created clears the sand, silt or like material covering the area.

This method of dredging is particularly useful for providing a trench across the sea bed. The wing shape casing is slowly towed along a line above the sea bed and the thrust means, which is directed vertically downwards, excavates a trench in the sea bed of a width which depends upon the material of the sea bed, its altitude above the sea bed, the power in the thrusters, its speed over the sea bed, and its pitch angle. In a typical example, the width of trench formed will be of the same order as the width of the wing shape casing.

Such a dredger, which is commonly known as a "wing dredger" has been successful in producing a trench of a width sufficient to take a pipeline or, alternatively, to flatten an area of sea bed in preparation for works on the sea bed.

Reference is also made to EP-0419484 and GB 2315787 which describe wing dredgers is further detail.

The wing dredger is normally suspended below the support vessel by means of cables. One of the difficulties which has been found in practice with such an arrangement is that because of its relatively large surface area, the wing dredger will remain at a given depth, and the support vessel will of course rise and fall on the waves on the surface. This can cause unacceptable tension in the cables from the support vessel to the wing dredger and on the mounting means on the support vessel and the wing dredger, and a particular problem arises as the wing dredger is lifted towards the surface and is to be lifted out of the water onto the support vessel because, for example, the cable length by that time is considerable reduced and yet the support vessel is still moving up and down on the waves and the wing dredger is tending not to do so.

To a certain extent this problem can be overcome by providing in the lifting mechanism or in the cables a so called "heave compensator". Nevertheless, we have found this does not always operate quickly enough, especially with high waves. Heave compensators tend to be expensive and the amount of motion they can take into account is limited.

In seeking to address these problems and to provide a dredger which does not require to be slung from a boat upon the surface, the present invention has been devised.

SUMMARY OF THE INVENTION

In its broadest sense, the present invention provides a dredging apparatus comprising a body mounting first thrust means to direct, in use, a wash of water downwards towards an area of seabed or the like. The apparatus includes further thrust means to maintain the body of the apparatus above the seabed and to propel the body through the water. The body is in the form of a wing comprising a casing having ballast tanks to adjust to its submerged weight.

Preferably the further thrust means are arranged so that, in combination, they act as an attitude adjusting means to selectively adjust the attitude of the apparatus in a side to side (roll) orientation; and, independently, in a front to rear (pitch) orientation.

Preferably, to assist in taking the body down towards the seabed, the body will include means adapted to carry solid ballast, such as concrete blocks or iron chains, which can be jettisoned upon completion of a job to enable the dredger to return to the surface.

Conveniently, the casing is provided with an angled face at least along one (leading) edge thereof which at least in part, causes the resultant downward force component in use; this component can be varied by appropriately tilting the casing so that its upper surface is angled to the horizontal.

The first thrust means may comprise one or more propellers, each mounted within an open or bore, to rotate substantially parallel to the plane of the casing, in which case drive means for the propeller(s) are mounted on the casing. Means may be provided so that the direction of the jet streams can, separately or severally, be caused to flow inwards and outwards, as well as to the front and rear. In this way the jets may be set inwards and outwards with reference to the wing's centre point through a measured circumference of 360 degrees with the plane of the propellers rotating at an angle of typically no more than about 40–45 degrees to the horizontal.

The further thrust means preferably also comprise one or more propellers driven by respective drive means.

In one embodiment, the drive means derive their power from an on-board engine, typically a diesel engine.

Typically, the drive means comprise electric motors and the power is supplied by means of a diesel-electric power plant. Alternatively, the engine may operate a hydraulic pump, circulating pressurised fluid through the drive unit via flexible hoses, the drive unit comprising an hydraulic motor including gearing which meshes suitably with gearing on the or each propeller shaft.

Preferably, the engine receives a supply of air from a supply of compressed oxygen stored in suitable cylinders in the body of the apparatus itself. Preferably, carbon dioxide is stripped from the exhaust gases and discharged and the remaining nitrogen rich air is replenished with oxygen from the compressed oxygen supply and returned to re-aspirate the engine.

Alternatively, the engine receives an air supply and discharges its exhaust gases by means of a snorkel arrangement to the surface.

In a second embodiment, power is supplied from an external source. Preferably this is an engine, typically a diesel engine, housed within a suitably protected buoy floating on the surface of the water. The engine powers an electrical generator or hydraulic pump, the output from which is transmitted to the drive means in the body of the apparatus by means of an umbilical cord. In a modification of this embodiment, the power is supplied by means of an umbilical cord from a submarine or semi-submersible travelling above the apparatus.

The body of the apparatus will typically also house a number of sensors and scanning instruments. These will detect the orientation of the body, its heading, height above the seabed, the geography and geology of the seabed etc. These instruments and the control systems for the various thrust means all clearly require communication with the operators of the apparatus on the surface in a support vessel. This may be achieved by means of radio signals. An aerial lead from the body of the apparatus communicates with an aerial mounted upon a buoy floating on the surface. From there, signals are transmitted to and from the support vessel. Clearly, where the apparatus includes a snorkel or the engine is mounted within a buoy on the surface, suitably the aerial will be mounted on the same buoy.

However, preferably, the motion of the dredging apparatus and its on-board sensors and instruments is controlled from the support vehicle (ship on the surface, submarine, submersible or a remotely operated vehicle) by means of multi-channel sonar, each channel controlling a specific motion thruster or item of equipment.

BRIEF DESCRIPTION OF THE DRAWINGS

The above and other aspects of the present invention will now be described by way of example only and with reference to the accompanying drawings in which.

DETAILED DESCRIPTION OF THE PREFERRED EMBODIMENT

In order to promote a fuller understanding of the present invention, we will begin by discussing the operation of a prior art dredger.

Figure 1:
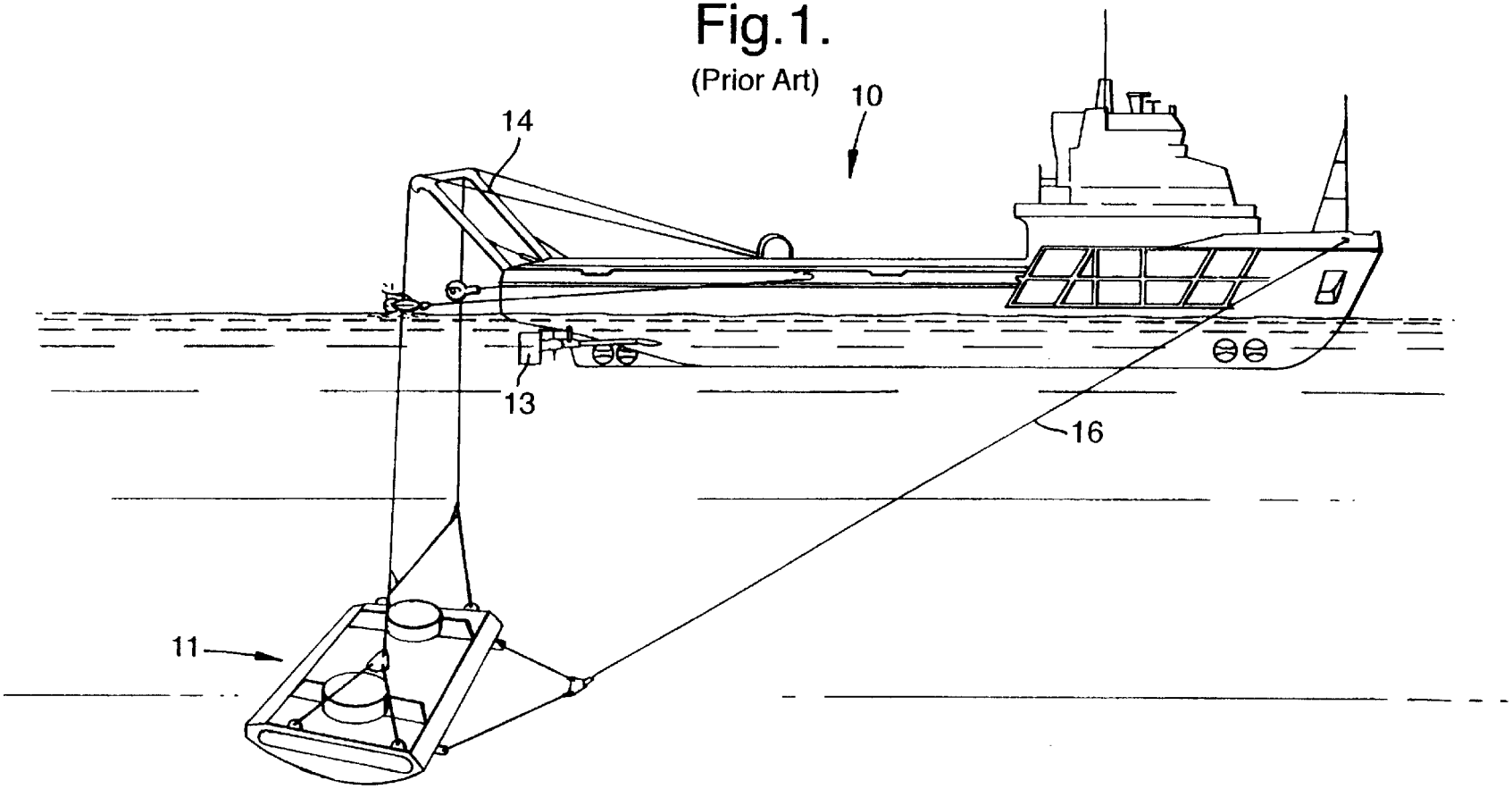
Fig. 1. (Prior Art)
FIG. 1 is a side view of a prior art wing dredger in operation.

Referring to FIG. 1, a support vessel or mother vessel 10 is shown moving forward or stationary heading into a tidal flow. The tidal flow may be in a river, estuary, or at sea. This wing dredger 11 is suspended at an appropriate distance from the sea bed via a pair of cables 12, 13, one cable extending from each side of a lifting means 14 on the mother vessel 10 and there is provided a further cable 16 from adjacent the bow of the vessel 10.

Figure 2:
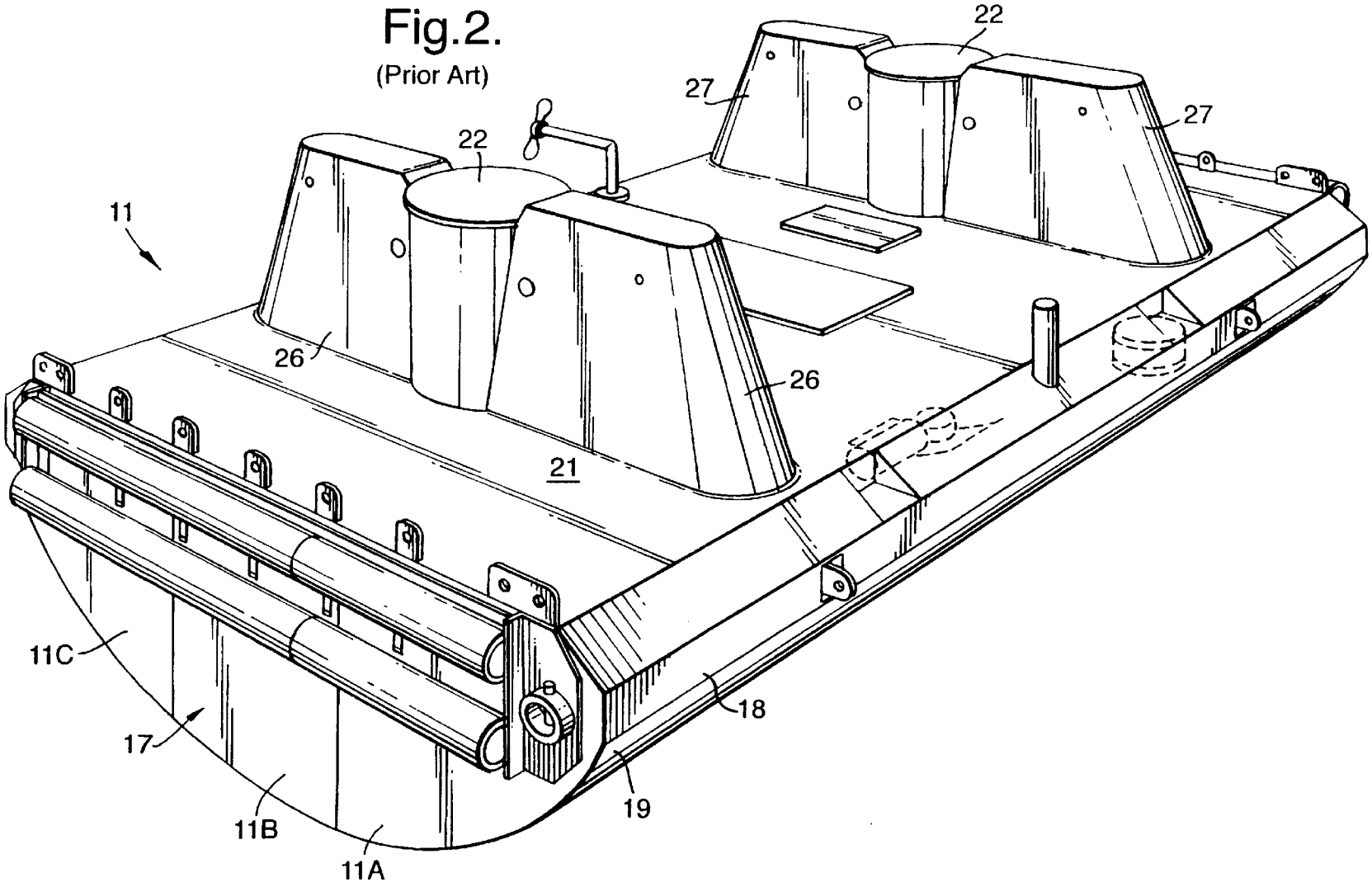
Fig.2. (Prior Art)
FIG. 2 is a perspective view of the wing dredger of FIG. 1.
Figure 3:
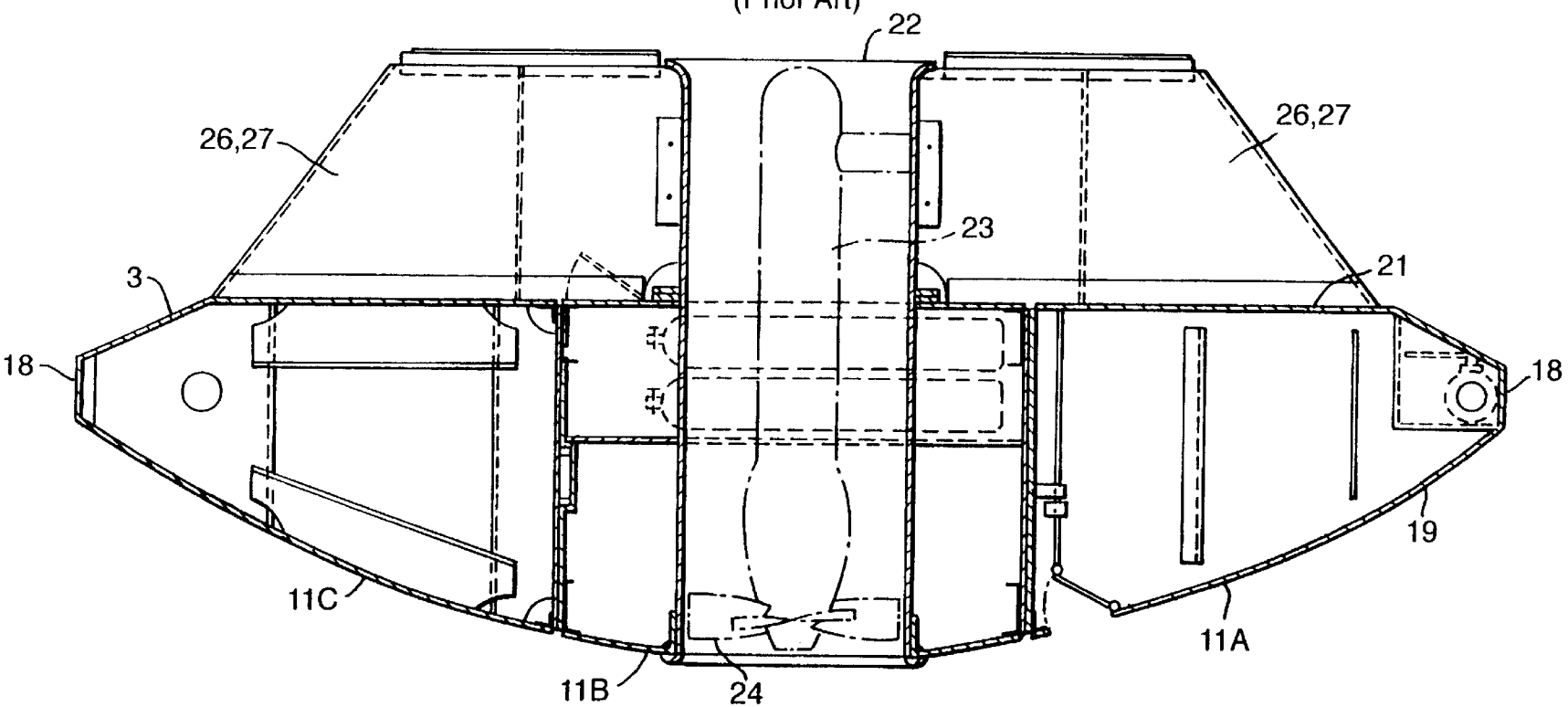
Fig.3. (Prior Art)
FIG. 3 is a cross section through the wing dredger of FIG. 2.

As illustrated in FIG. 2, the wing dredger has a hydrofoil cross section and is rectangular in plan. It is constructed as a casing comprising vertical end walls 17, connected by laterally extending wall 18, which provide lower angled faces 19 to provide a downward component of force when acted on by tidal flow providing as stability. The upper wall 21 is generally flat. Referring to FIG. 3, it will seen that this wing dredger 11 is constructed of three units, a front unit 11A, and mid-unit 11B and a rear unit 11C connected together, so that the wing dredger can be split into three sections for ease of transportation.

Each of the three units 11A, 11B and 11C are of steel skin construction and units 11A and 11C are hollow closed boxes. The hollow closed boxes are divided into compartments by suitable bulkheads.

It will be seen from FIG. 3 that the wing dredger is symmetrical about its lateral axis so that it can be used in either direction with the respective end wall 18 leading. The dredger 11 is provided with two closed vertical bores 22 which are laterally spaced from each other, each housing a thrust means 23 in the form of a motor driven propeller 24 mounted substantially in the plane of the wing 11 and the two propellers are driven in opposition to reduce the effects of centrifugal/centripetal forces. Where the two contra-rotating vertical jet vortices meet, very high forces are created which increase seabed penetration.

Upwardly extending from the upper wall 21 are a pair of fins 26 and 27 each extending from adjacent the front edge to adjacent the rear edge. Each closed vertical bore 22 extends up through a respective fin 26,27. The propellers are driven by respective electric motors.

In use, a downward vertical component of force is provided by the leading angled face 19 when acted upon by the tide or other flow of water, and/or forward speed of the vessel, which component can be increased by adjustment of the cables to tilt the casing, and hence the upper wall 21 thereof appropriately to the horizontal.

In a practical construction capable of operating down to a depth of approximately 300 meters of water, the wing dredger has dimensions of the order of 9000 mm wide, by 6000 mm long and 2600 mm high. With a wing dredger of such size tilted 10–15 degrees from the horizontal, a resultant hydro-dynamic downward vertical component of force of up to about 9.5 tonnes is generated when the wing moving or subject to a tidal flow of about 4½ knots (8.3 km/hr). The thrusters are designed to produce a thrust of between 0.5 and 2.5 tonne each.

The wing 11 is provided with a number of ballast tanks so that the weight of said casing can be adjusted by the injection/ejection of a suitable ballast medium such a water and/or sand, silt, etc. from the area being cleared. Means for controlling the buoyancy of an underwater object are well known and reference is made, for example, to I. B. McDonald's paper in *Oceanology International* 72, pp 424 et seq.

To recover the smallest articles from a wreck, preferably the lowest thrust required to lift the material to be cleared should be used. Thus, it will be appreciated that weight adjustment of the wing is necessary, depending upon the depth at which working is to be effected and the amount of thrust required to be generated by the propellers, which in turn will depend upon the nature of the material being cleared, e.g. light or heavy sand, silt, gravel etc.

Figure 5:
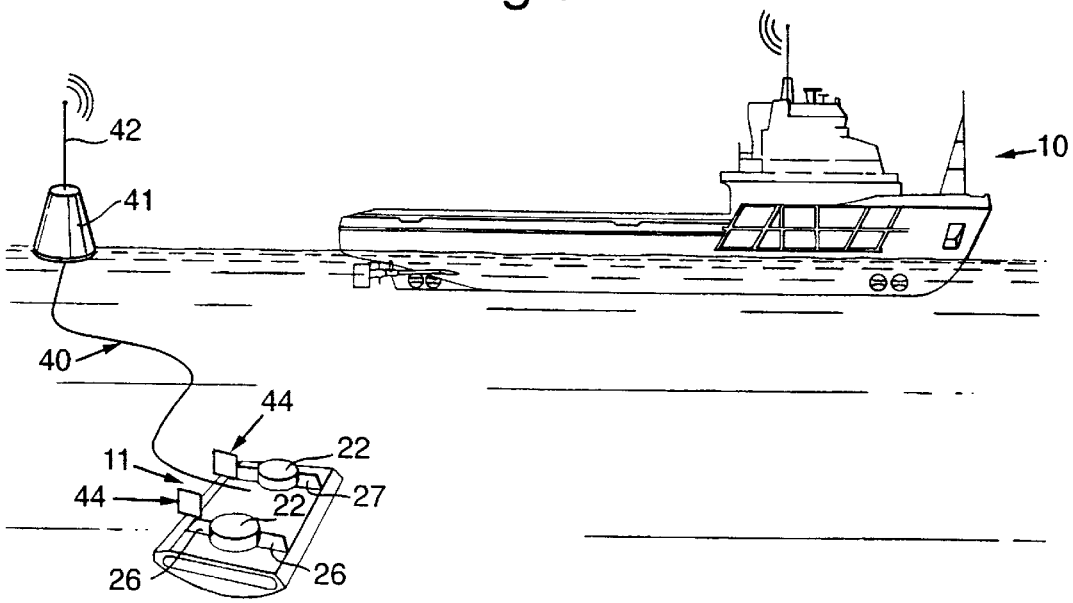
FIG. 5 is a side view of a first embodiment of a wing dredger in accordance with the present invention in use.

With reference now to FIG. 5, there is shown, schematically, a first embodiment of a dredging apparatus in accordance with the present invention. The body 11 of the apparatus is self-propelling through the water and so does not require tethering to the support vessel 10. Except as otherwise stated, the dredging operation of the wing dredger shown is essentially the same as described above and the same reference numerals indicate the same components as in the prior art wing dredger. The body of the apparatus houses a diesel engine (not shown). For the 9 m×6 m dredger described above, an engine with an output of around 600HP will be suitable. The engine is aspirated and exhausted by means of a snorkel forming a part of an umbilical cord 40. Such snorkels are well known in the field of submarines. For example, suitable systems are described in U-Bootbau by Ulrich Gabler, published by Wehr & Wissen (1973) (ISBN 3-8033-0260-9) to which further reference should be made. For protection from the elements. the ventilation head of the snorkel terminates inside the body of a buoy 41 floating on the surface of the water above the body 11. A diesel engine of around 600HP will require an air input of around 2300 $m^3$ per hour. The buoy 41 will, to a certain extent, be towed around as the body 11 of the apparatus moves around the seabed. Those skilled in the art of snorkel design will be readily able to determine suitable dimensions, materials and constructions for the umbilical cord which will withstand the tensions placed upon the cord in use and allow the required amount of air to flow to the engine.

In addition to providing the power for the first thrust means 23 which provide the scouring of the seabed surface, the engine also provides power to further thrust means in the form of positioning thrusters to manoeuvre the wing in an altazimuth manner, both to and from the work-site and along the seabed. Suitable arrangements of such positioning thrusters will be described in further detail below with reference to the preferred embodiment. However, in the arrangement shown, the positioning thrusters include a pair of propellers 58,59 mounted on respective fins 26, 27, each being capable of being run in reverse. The positioning thrusters also include propellers for adjustment of the attitude of the wing and altitude above the seabed. These are conveniently mounted in a similar configuration to that used on one-man submarines. They may be a pair of directionally adjustable propellers mounted on respective sides of the wing, or may comprise two sets of propellers, one mounted for vertical movement and one for fore/aft motion. With this arrangement of motion thrusters, it will also be possible to adjust the side to side inclination of the wing to enable dredging of wider channels, as is described in our corresponding application GB 2 315 787.

The body of the apparatus also houses a number of sensors and scanning instruments. These detect the orientation of the body, its heading, height above the seabed, the geography and geology of the seabed etc. These instruments and the control systems for the various thrust means all clearly require communication with the operators of the apparatus on the surface in a support vessel. In the embodiment shown in FIG. 5, this is achieved by means of radio signals. An aerial lead (or more preferably a range of aerial leads with specific enhanced frequency responses for the wide range of frequency outputs of the apparatus used) within the umbilical cord 40 from the body of the apparatus communicates with an aerial (or aerials) 42 mounted upon the buoy 41 floating on the surface. From there, signals are transmitted to and from the support vessel 10. Alternatively, in order to avoid possible loss of signals particularly in high seas, the communications system may use transmissions via satellites.

To assist in taking the body down towards the seabed, the body includes means adapted to carry solid ballast, such as concrete blocks or iron chains, which can be jettisoned upon completion of a job to enable the dredger to return to the surface. To return to the surface, the dredger will use its thrusters and rudders 44 to direct the wing on an inclined path towards the surface. Once at the surface or very close thereto, the ballast tanks can be blown.

In a modification (not shown), power is supplied from a diesel engine, housed within a suitably protected buoy 41' floating on the surface of the water. The engine powers an electrical generator or hydraulic pump, the output from which is transmitted to the drive means in the body of the apparatus by means of the umbilical cord 40'. In a modification of this embodiment, the power is supplied by means of an umbilical cord from a submarine running above the apparatus.

Figure 4:
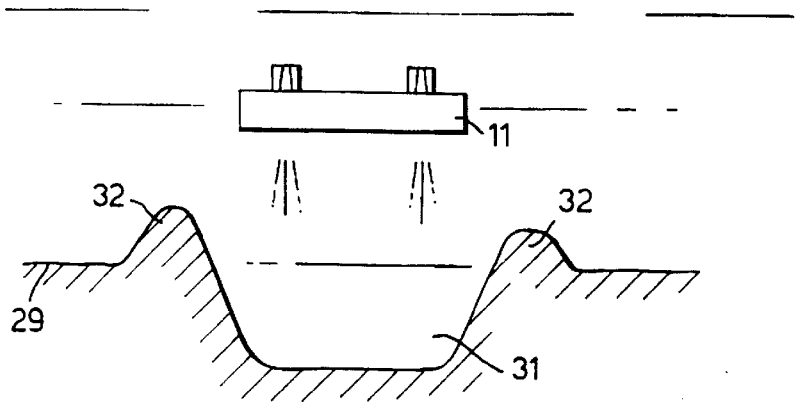
FIG. 4 is a diagrammatic front view of a wing dredger in accordance with the present invention, in normal orientation and use.

Referring to FIG. 4, there is shown in a very diagrammatic form a front view of a wing dredger as above described passing at a meter or two above the sea bed 29 and as a result of the downward thrust of the propellers 24, there is produced a trench 31 in the sea bed 29. At least some of the material which has been dislodged from the sea bed to produce the trench 31 is deposited on each side of the trench 31 to form a ridge 32.

Figure 6:
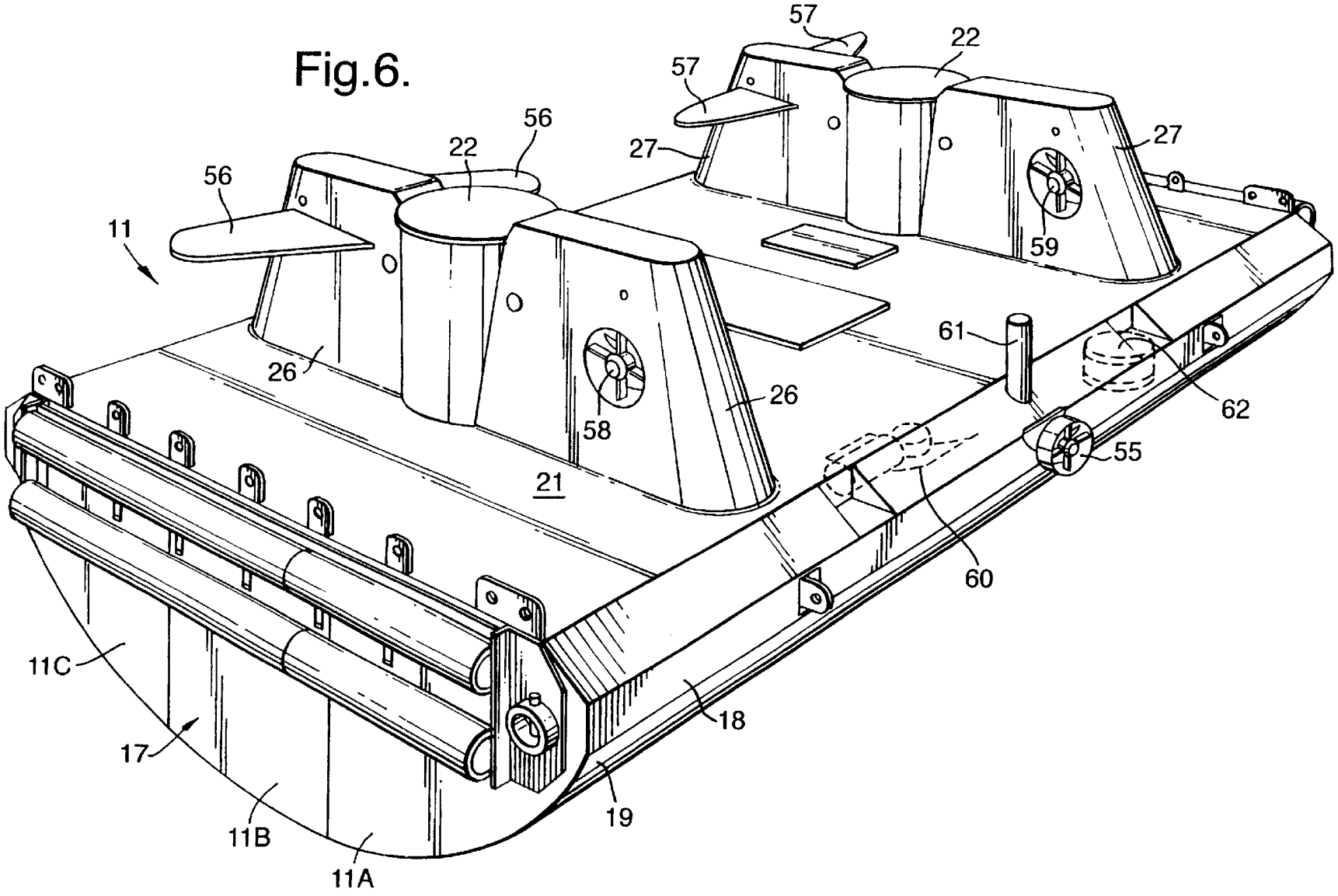
FIG. 6 is a perspective view of a second embodiment of a wing dredger in accordance with the present invention.

A preferred embodiment of a wing dredger in accordance with the present invention is shown in FIG. 6, in which reference numerals common with FIGS. 2 and 3 indicate similar features in this embodiment with the same characteristics as described above. In this embodiment, the wing dredger, shown generally at 50, includes a diesel engine (not shown) housed in the central section 11B. The engine receives its oxygen supply from a compressed gas supply in the body of the wing 50 and includes apparatus for recycling the exhaust gases to provide a carrier and diluent for the pure oxygen supply. Such apparatus is not shown or specifically described further as full details of such systems are already well known in the art. In particular, further reference should be made to Paper number 710827 by J. R. Puttick of Ricard & Co Limited presented to the Society of Automotive Engineers' National Combined Fuels and Lubricants Powerplant and Track Meetings, St. Louis, Mo., Oct. 26–29, 1971. Otherwise, the operation of the apparatus is substantially as described above.

As shown, each fin 26,27 is fitted with respective pairs of elevators 56,57 which act to guide the wing dredger, in use, during descent and surfacing and to aid recovery of the apparatus. As described above, the engine also provides power to a number of positioning thrusters. These include sideways positioning thruster reversible propellers 58,59 mounted within respective fins 26,27. The housings of the propellers 58,59 may also be mounted for rotation within the fins to provide a fine-adjustment mechanism for the wing. The positioning thrusters also include one or more propeller units mounted in a similar configuration to that used on one-man submarines. They may comprise a pair of directionally adjustable propeller units 55, one mounted on the on the leading edge of the wing and another mounted on the rearward edge. These propeller units 55 allow forward and reverse adjustment of the apparatus. Preferably, the axis of rotation of each unit is arranged to be adjustable such that a certain degree of sideways motion of the apparatus can also be achieved.

As described above, the wing dredger includes a number of sensors and scanning instruments. For example, the wing dredger of FIG. 6 shows the provision of a motion sensor and gyroscope unit 60; transponders 61 fore and aft to enable precise location and thus alignment of the dredger; together with survey data transmission and reception apparatus 62.

In the preferred embodiment, the motion of the dredging apparatus and its on-board sensors and instruments is controlled from the support vehicle (ship on the surface, submarine, submersible or a remotely operated vehicle) by means of multi-channel sonar. This means of control allows almost real-time remote control of the movement and activities of the dredging apparatus from distances, with current technology, of up to 800 meters. Suitable systems are well known in the art.

Figure 7:
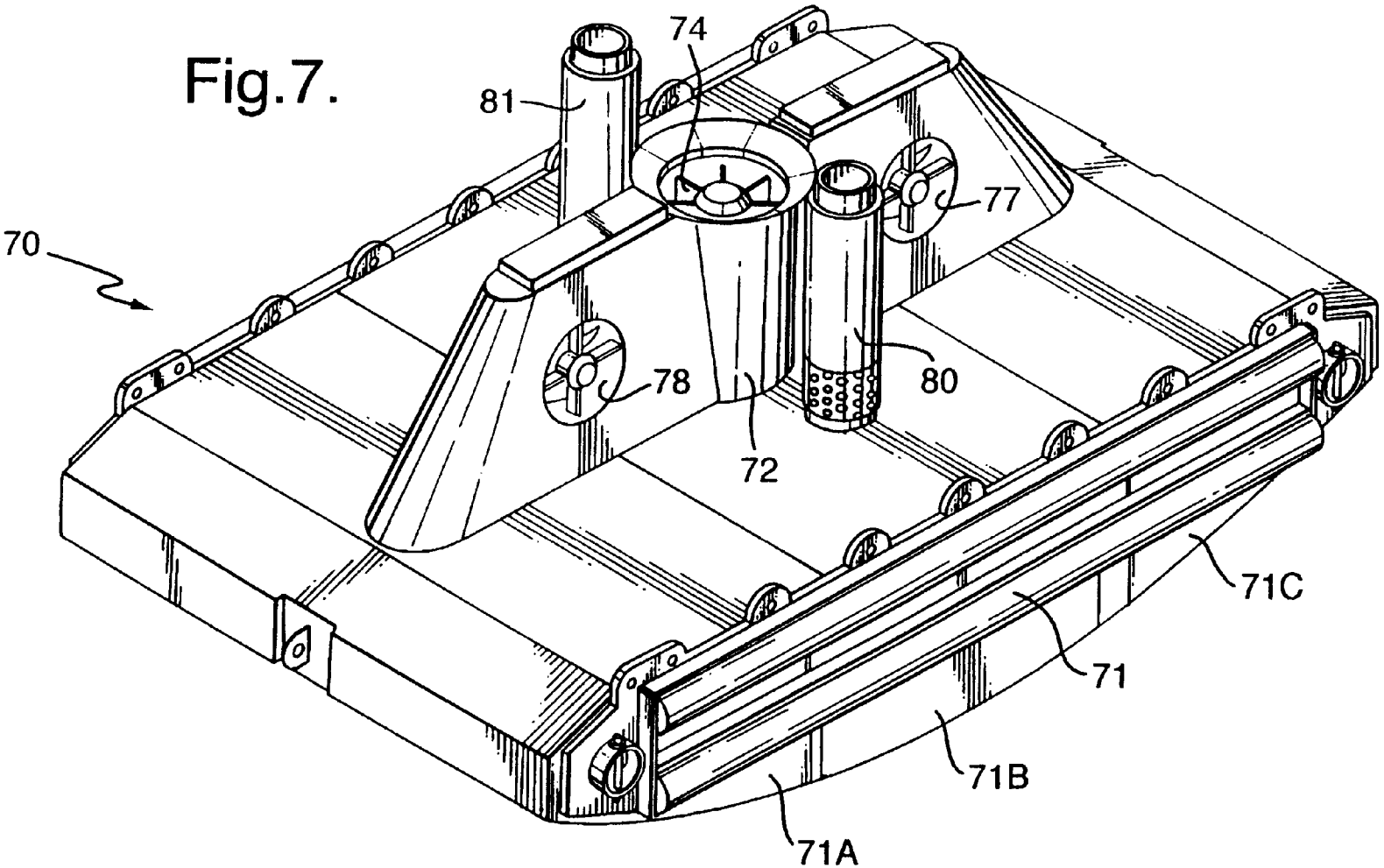
FIG. 7 is a top perspective view of a third embodiment of a wing dredger in accordance with the present invention.
Figure 8:
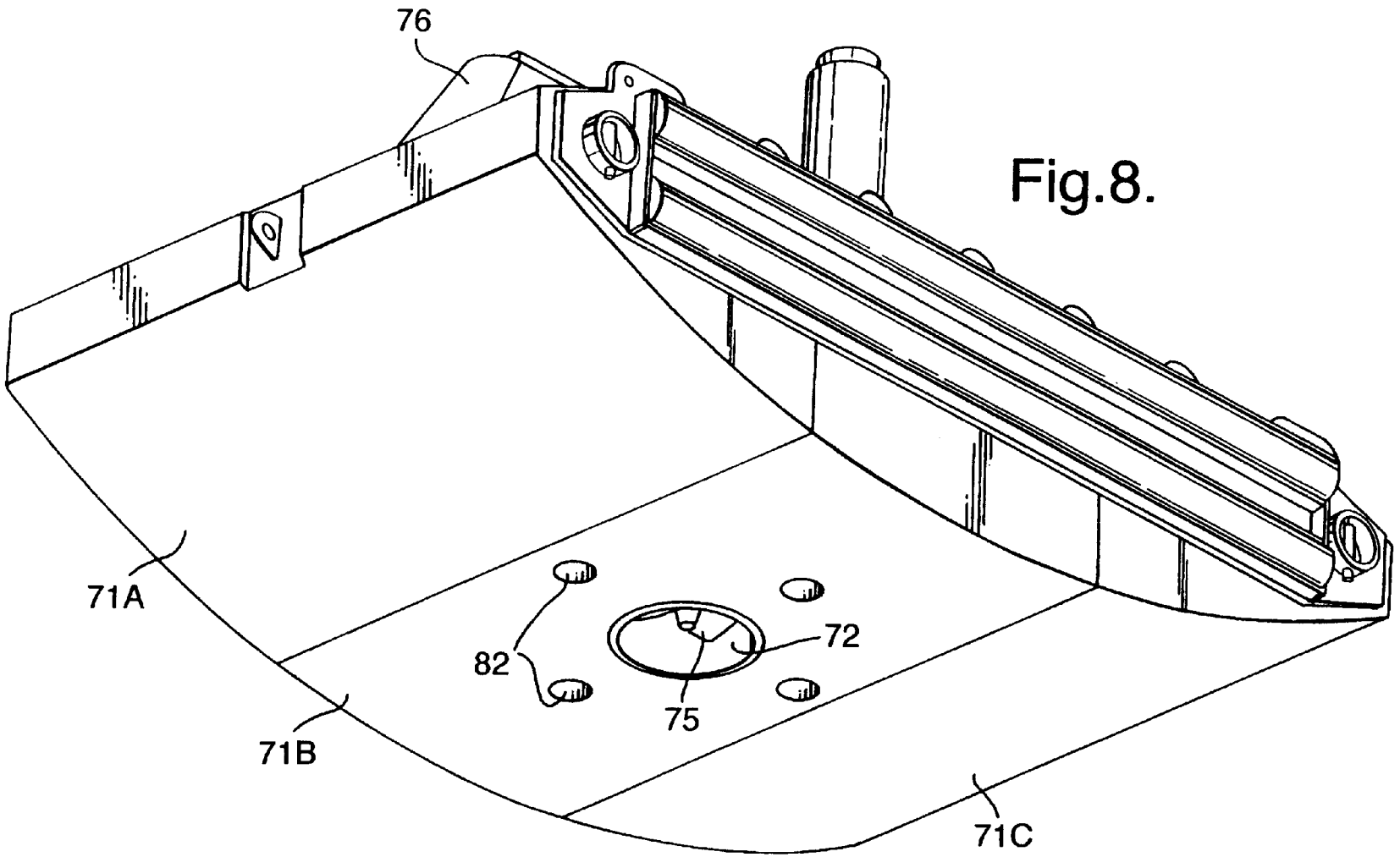
FIG. 8 is a bottom perspective view of the embodiment of FIG. 7.

A further embodiment of a wing dredger is illustrated in FIGS. 7 and 8. The wing dredger is of smaller overall dimensions than those described above, for use in situations where there may be less room to manoeuvre a large wing dredger or a less powerful dredger is all that is needed. As shown, the dredger 70 comprises a wing body 71 comprising forward, middle and rearward sections 71A, 71B and 71C substantially as described above with respect to the larger dredger. This embodiment includes a single central vertical bore 72 housing thrust means 73 in the form of a pair of propellers 74,75. The bore 72 extends, as in the embodiments described above, upwardly through an axial fin 76 in which are mounted two positioning thrusters 77,78, one fore and one aft. The dredger includes a pair of jets pumps 80,81 positioned either side of the fin 76. The jet pumps supply powerful jets of water from a plurality of outlets 82 in the underside of the wing. As shown, there are four such outlets arranged around the bottom exit of the vertical bore 72. Alternative arrangements are equally possible within the central section 71B of the wing as desired. The pressure jets 82 are particularly suitable for cutting hard clays. This feature may also be added to any of the other embodiments of the wing dredger described above. Furthermore, as space provides or as required, the jet pumps 80,81 can be mounted within the body of the dredger.

A dredger described above has many uses, for example, it can be simply used for a normal dredging purpose, that is clearing a channel in a river or the sea. A dredger of lateral dimensions approximately 9 m×6 m may be used to clear from a river or sea bed of heavy clay a channel approximately 10 m wide, 5 m deep and 100 m long in approximately 6 hours. Thus in that 6 hour period it moves of the order of 300 tonnes of heavy clay.

Clearly if the river or sea bed is of sand or silt, then a much larger volume of material would be removed in that six hour period.

In addition to dredging, the dredger may be used in salvaging, that is for clearing mud and silt from wrecks.

A particularly interesting use is to level the seabed and then dredge a trench in which oil/gas pipelines may be laid and then by a similar "agitation" operation of the dredger, the trench may be backfilled.

The dredger may be used to clear silt away from what is called in the oil industry, "Christmas trees", around buried debris, such as ordinance, and for freespan recitification.

The dredger may also be used to level a site on which an oil platform is to be mounted and can be conveniently used to remove the silt which accumulates around the legs of an oil rig, so that the oil rig may be removed.

In another use, the dredger may be used to remove the top layer of silt from the river or sea bottom so that an offshore mining operation can get to the required lower layers. To reduce environmental effects, the silt may be removed in small thicknesses at a time.

The dredger can be used for localised shaped excavations such as directional drilling exit holes.

Other uses of the dredger include disturbing the bottom of a river to maintain in the stream toxic substances which would otherwise settle on the bottom of the river so that the river and river bed lift is improved.

The dredger is particularly suitable for sandwave levelling and pre-sweeping and also the removal or dilution of muds and silts of various densities. It is also suitable for rockdump removal, rockberm removal and for widening and deepening channels.

In this application, it is to be understood that the term 'seabed' includes similar areas such river beds, estuaries, lakes etc.

What is claimed is:

1. A dredging apparatus, comprising:

a body mounting first thrust means for directing, in use, a wash of water downwards towards an area of a seabed; and further thrust means for maintaining the body of the apparatus above the seabed and to propel the body through the water, wherein the body is a wing comprising a casing having ballast tanks to adjust a weight of the body.

2. A dredging apparatus as claimed in claim 1, wherein the further thrust means are arranged to act as an attitude adjusting means for selectively adjusting an attitude of the apparatus in a side to side (roll) orientation and, independently, in a front to rear (pitch) orientation.

3. A dredging apparatus as claimed in claim 1 or claim 2, wherein the body includes means for carrying solid ballast including concrete blocks and iron chains.

4. A dredging apparatus as claimed in claim 1 or claim 2, wherein the first thrust means comprises one or more propellers each mounted within a bore to rotate substantially parallel to a plane of the body.

5. A dredging apparatus as claim 1 or claim 2, wherein the further thrust means comprises one or more propellers driven by respective drive means.

6. A dredging apparatus as claimed in claim 1 or claim 2, wherein the first thrust means and the further thrust means are driven by drive means which derive power from an engine.

7. A dredging apparatus as claimed in claim 6, wherein the engine receives an air supply from, and discharges exhaust gases to a position above a surface of the water through a snorkel arrangement.

8. A dredging apparatus as claimed in claim 6, wherein the engine receives an air supply from a supply of oxygen stored in cylinders in the body of the apparatus.

9. A dredging apparatus as claimed in claim 5, wherein power for the apparatus is supplied from an external source, wherein the external source powers one of an electrical generator and a hydraulic pump, and wherein an output of said one of the electrical generator and the hydraulic pump is transmitted to the drive means in the body of the apparatus by an umbilical cord.

10. The dredging apparatus of claim 6, wherein the engine is an on-board diesel engine.

11. The dredging apparatus of claim 6, wherein the drive means comprise an electric motor.

12. The dredging apparatus of claim 6, wherein the drive means comprise a hydraulic motor.

13. The dredging apparatus of claim 6, further comprising means for cleaning and recycling exhaust gases from the engine.

14. The dredging apparatus of claim 9, wherein the external source is a diesel engine.

15. The dredging apparatus of claim 9, wherein the external source is housed within a buoy floating on a surface of the water.

16. The dredging apparatus of claim 9, wherein the external source is housed within a semi-submersible body traveling above the apparatus.

17. The dredging apparatus of claim 9, wherein the external source is housed within a submarine traveling above the apparatus.

* * * * *